United States Patent [19]

Lührig et al.

[11] 4,264,718

[45] Apr. 28, 1981

[54] PHOTOGRAPHIC FILM UNIT OF INTEGRAL STRUCTURE

[75] Inventors: Hermann Lührig, Leverkusen; Guido Kovacic, Unkel; Walter Tabel; Horst-Peter Müller, both of Cologne, all of Fed. Rep. of Germany

[73] Assignee: AGFA-Gevaert, A.G., Leverkusen, Fed. Rep. of Germany

[21] Appl. No.: 63,463

[22] Filed: Aug. 3, 1979

[30] Foreign Application Priority Data

Aug. 8, 1978 [DE] Fed. Rep. of Germany ..... 2834626

[51] Int. Cl.[3] ..... G03C 1/48; G03C 1/76

[52] U.S. Cl. ..... 430/499; 430/207; 430/208; 430/209; 430/497

[58] Field of Search ..... 430/207, 208, 209, 497, 430/499

[56] References Cited

U.S. PATENT DOCUMENTS

| | | | |
|---|---|---|---|
| 3,672,272 | 6/1972 | Cole | 430/207 |
| 3,826,655 | 7/1974 | Borel et al. | 430/207 |
| 4,042,395 | 8/1977 | Tone et al. | 430/209 |

*Primary Examiner*—Richard L. Schilling

*Attorney, Agent, or Firm*—Connolly and Hutz

[57] ABSTRACT

The invention relates to a photographic film unit with integral structure consisting of an image sheet and a cover sheet which is substantially in register with the image sheet and firmly attached to it, whereby the attachment between the sheets is produced by a combination of individual masking strips and lateral spacer strips and said combination of multi-part mask is composed of a masking folding sheet associated with the container for photographic developer material and another associated with the trap and a separate lateral masking strip for each side.

13 Claims, 5 Drawing Figures

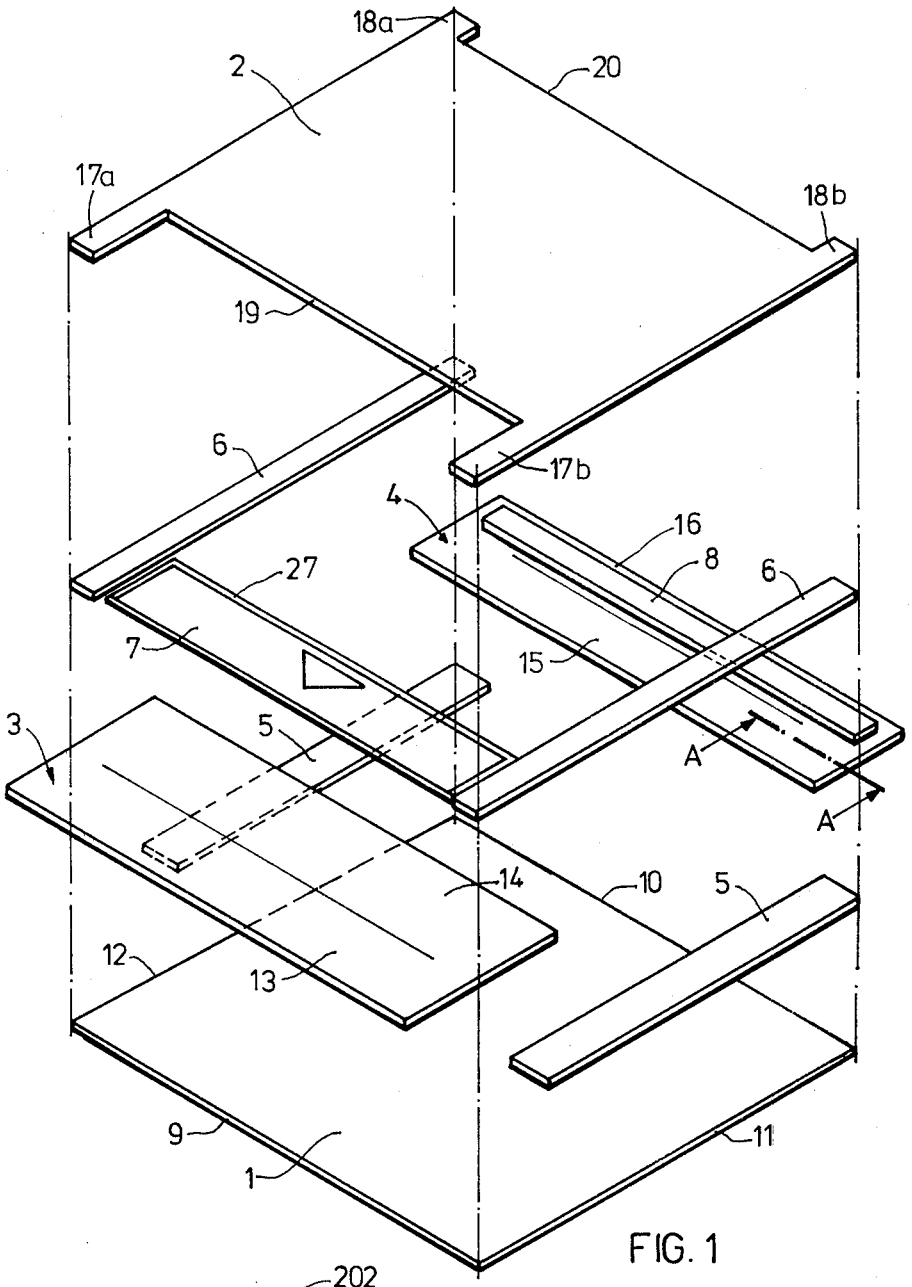
FIG. 1
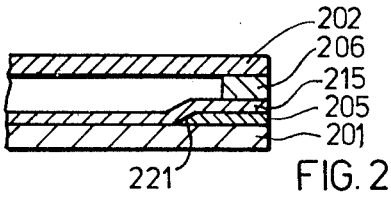
FIG. 2 (A-A)

PHOTOGRAPHIC FILM UNIT OF INTEGRAL STRUCTURE

This invention relates to a photographic film unit with integral structure consisting of an image sheet and a cover sheet which is substantially in register with the image sheet and firmly attached to it. The attachment between the sheets is produced by a combination of individual masking strips and lateral spacer strips which limit the image field, cover the container for developer paste, cover a trap for excess developer paste and maintain the necessary distance between the two sheets for a given thickness of the layer of developer paste.

In known instant image units, the devices used to limit the image area and produce the necessary distance between the two sheets for a given thickness of the layer of developer paste are composed of a homogeneous, i.e. one part mask for limiting the image area and additional spacer strips for producing the desired distance between the two sheets. An arrangement of this type has been described in German Offenlegungschrift No. 2,519,987 and in U.S. Pat. No. 3,689,269. In the known instant image units, the image window necessary for confining the image area is punched out of a suitable mask material. This punching operation entails some serious disadvantages. A high proportion of the mask material (at least 50%) is wasted. This waste of normally expensive starting material must be completely removed from the punching station of the processing machine and destroyed. Since the elimination of waste is frequently problematic in the case of certain materials, it is desirable in these times of increasing awareness of environmental problems to avoid such losses. When the image window has been punched out of the masking strip, the problem arises that the masking strip left behind, which is in the form of a ladder, is considerably reduced in cross section and therefore in its stability. It is therefore easily pulled out of shape in subsequent processes. This distortion of the strip makes it necessary either to use expensive constructional counter measures or to reduce the manufacturing speed. In practice, it has been found that distortions of the image window which has originally been punched out in an exactly rectangular form cannot be completely prevented despite these measures. Moreover, when the developer paste is spread out, air bubbles tend to adhere to the edges of the mask which limit the image area and become enclosed by the developer paste so that troublesome edge effects are produced in the form of black points.

It is therefore an object of the present invention to provide an instant image unit with integral structure in which the boundary to the image area formed by a mask can be obtained as an exact rectangle by quite simple apparatus and with little waste and the image edge effects mentioned above can be suppressed.

To solve this problem according to the invention, the mask is formed as a multi-part mask combination which is composed of a masking folding sheet associated with the container for photographic developer paste, a similar masking folding sheet associated with the trap and separate laterally placed masking strips.

The use of a multi-part mask combination would at first sight appear prohibitively difficult since instead of a homogeneous mask it is necessary to produce several individual parts and join them together in exact registration. This would appear at first to need a huge technological expenditure.

Joining together the several individual parts, one above the other, is liable to cause difficulties in obtaining a perfect seal, and one would also expect difficulties due to the cumulative thickness of material produced by the arrangement of lateral masking strips and the masking parts of the folding sheets one above the other.

It was therefore surprising to the man of the art to find that these difficulties are only apparent. In fact, there are even considerable advantages in multi-part mask combinations compared with the conventional homogeneous masks.

Difficulties may possibly arise in the region of the trap due to leakage of the paste at the points of intersection of the individual parts of the mask but since very thin materials are used for the parts of the mask according to the invention, the wedge-shaped cavities in the areas of intersection are so small that they become filled up by the adhesive used for bonding the parts together. In cases where thicker materials are used, the formation of these cavities can advantageously be prevented by chamfering off the edges of the mask bordering the image area. In addition, the tools used to press the adhesive connection into position may be stepped in the region of the intersections. The thickening due to the superimposition of the several masking strips with the part of the mask formed by the folding flap on the side of the bag containing the developer paste would only prevent complete squeezing out of the paste if the lateral masking strips reached to the front edge of the image unit. This additional thickness could be compensated by using a thicker foil for the pod or by inserting a layer of suitable thickness. It is preferable, however, to use lateral masking strips which only slightly intersect with the part of the mask formed by the folding sheet on the side of the bag or to form notches in the masking part of this sheet. In the area of the trap, a thickening of the edge is even an advantage owing to the increase in volume thereby obtained for the trap.

Since the mask of the integral film unit according to the invention is composed of individual strips, no apparatus for punching out the image window and removing the resulting waste are required in the manufacturing machine.

As a technological problem, the application of the masking strips is identical to the problem of applying spacer strips. This problem is successfully dealt with in practice. The application of masking folding sheets which are supplied in the form of strips in the process of manufacture is comparatively unproblematic in contrast to the manufacture of a masking strip with punched out image windows and can be achieved with great precision. It can be seen from this that the technical effort required for manufacture is surprisingly reduced despite the fact that the mask is made of several parts.

Another advantage of the image unit according to the invention arises from the fact that the thickness of the material of the masking folding sheets and the thickness of the masking strips are variable independently of each other and can therefore be optimally adapted to the given function in any particular case. Thus, for example, lateral masking strips only require to be thick enough to form boundaries to the image area on both sides. When a homogeneous mask is used, however, the material must have a certain thickness owing to the reduction in the stability of the masking strip when the image window is punched out.

Instead of a material in the form of a sheet, other, even thinner materials may be used as lateral masking strips for multi-part mask combinations, e.g. liquid or transfer materials. By using extremely thin materials for the mask at the sides, the edge effects due to the inclusion of air bubbles can be prevented. This can also be achieved by chamfering off those edges of the individual parts of the mask which form the boundary to the image area. This chamfering is not possible in homogeneous masks produced by punching out.

The invention will now be described in more detail with reference to the accompanying drawings, in which:

FIG. 1 is an exploded view of an image unit according to the invention with laminar lateral masking strips;

FIG. 2 represents a section through an image unit according to the invention with chamfered off edges to the mask;

Figure 3:
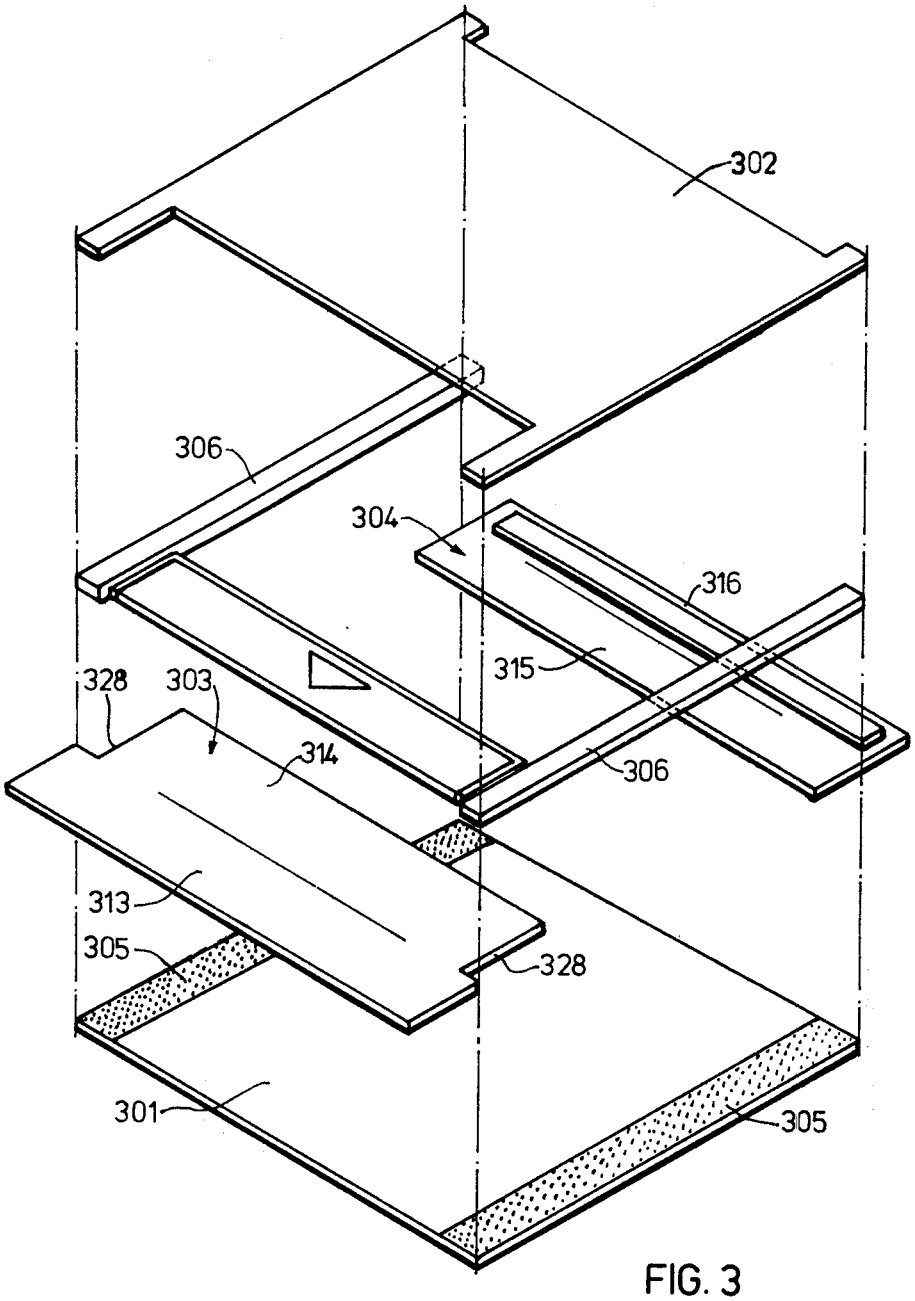
FIG. 3 is an exploded view of an image unit according to the invention with masking strips of liquid or transfer material and notches in the mask.

FIG. 1 represents a preferred embodiment of the photographic film unit with integral structure. The film unit consists of an image sheet 1 and a cover sheet 2 substantially in registration. The cover sheet 2 has a shortened middle part 19 on the side where the container 7 is situated and two narrow marginal portions 17*a*, 17*b*. The width and depth of the shortened middle part 19 are substantially equal to the length and width of the container 7 for developer paste. On the side where the trap 8 is situated, the image sheet also has a shortened middle portion 20 and two narrow marginal portions 18*a* and 18*b*. The dimensions of this recess are slightly smaller than the trap 8 inserted above it.

The integral film unit has a front edge 9 associated with the container 7 for developer paste and a rear edge 10 associated with the trap. After exposure, the paste used for development is spread over the film unit to the required thickness by passing the film unit with its front edge 9 forward through elements which exert pressure on it, a pair of cylindrical rollers being usable in known manner for this purpose. The resulting increase in pressure in the container 7 for developer paste breaks open the bursting seam 27 and the paste is spread over the image unit by the pair of rollers. Excess developer paste is received in the trap 8 associated with the rear edge 10 of the film unit.

Image sheet 1 and cover sheet 2 are bonded together along the lateral edges 11 and 12 by a multipart mask combination and separate lateral spacer strips 6.

The openings remaining between the image sheet and cover sheet at the front edge 9 and rear edge 10 of the film unit are closed by folding over the parts 13 and 16 of the two folding sheets of the mask and bonding them to the outside of the cover sheet 2. The container 7 for developer paste and trap 8 are thereby covered at the same time.

The container 7 for developer paste may be formed by the usual method of using a single sheet of material and folding the bottom, permanently sealing the lateral seams and making the front longitudinal seam a bursting seam 27.

The container may also be separated into several chambers or permanently sealed off in the space containing the paste or in the region of the bursting seam in order to ensure uniform distribution of the paste.

At the lateral edges 11 and 12 of the film unit, the lateral masking strips 5 form the boundries to the image area on the right and left. The masking parts 14 and 15 of the masking folding sheet 3 on the side of the container and the masking folding sheet 4 on the side of the trap form the boundaries to the image area at the side of the container 7 and of the trap 8, respectively.

The lateral masking strips 5 extend to just below the masking part 14 of the folding sheet 3 on the side of the container and almost up to the rear edge 10 of the film unit on the side of the trap and are permanently bonded to the image sheet 1 along the lateral edges 11 and 12. Since there is only slight overlapping with the masking part 14 of the folding sheet 3, there is no significant thickening in the region of the container.

The lateral masking strips 5 are preferably made of an opaque material, e.g. a polyester film in a thickness of from 5 to 50 μm. The thinner the masking film used, the more completely are the troublesome edge effects due to inclusion of air bubbles prevented.

The lateral spacer strips 6 extend into the masking folding sheet 3 on the side of the container and the masking folding sheet 4 on the side of the trap. These spacer strips 6 are permanently attached to the corresponding masking parts 14 and 15, the masking strips 5 and the cover sheet 2 along the lateral edges 11 and 12 of the film unit. The spacer strips 6 have substantially the same length as the cover sheet 2 and together with the lateral masking strips 5 they ensure that the paste forms a layer of the necessary thickness.

The trap is formed by a firm insert 8 which is capable of withstanding the pressure of the rollers and is covered in liquid tight fashion by the folded-over part 16 of the masking folding sheet 4 on the side of the trap. The pair of rollers which are normally spring mounted are spread apart by the incompressible trap insert 8 so that excess paste collected in the trap cannot flow back into the image area.

FIG. 2 shows another variation of the preferred embodiment according to FIG. 1. In this case, the lateral masking strips 205 which form the boundaries to the image area on the right and left side are chamfered off towards the image area as shown at 221. The masking parts 14 and 15 of the masking folding sheet 3 on the side of the container and of the masking folding sheet 4 on the side of the trap may also be chamfered off towards the image area. Since the increase in thickness is thereby made gradual, edge effects due to the inclusion of air bubbles are prevented.

Due to the gradual transition of the individual parts of the mask, wedge-shaped cavities at the areas of intersection of the individual parts of the mask are now not formed.

Another preferred embodiment of the film unit according to the invention is shown in FIG. 3. The multipart mask combination is in this case formed by a suitable application of material for the lateral masking strips 305. Suitable materials which can be applied from the liquid phase to form a mask include, for example, hot melts, heat sealing wax and other photographically inert and paste resistant lacquers. Transfer materials may also be used, for example hot stamping film or rub-off films. These materials can be produced in such very thin layers (less than 0.005 mm) that air bubbles can no longer get trapped on them to cause undesirable edge effects in the image. In this embodiment, the masking part 314 of the masking folding sheet 303 on the container side may have lateral notches 328 for insertion of the spacer strips 306.

Figure 4:
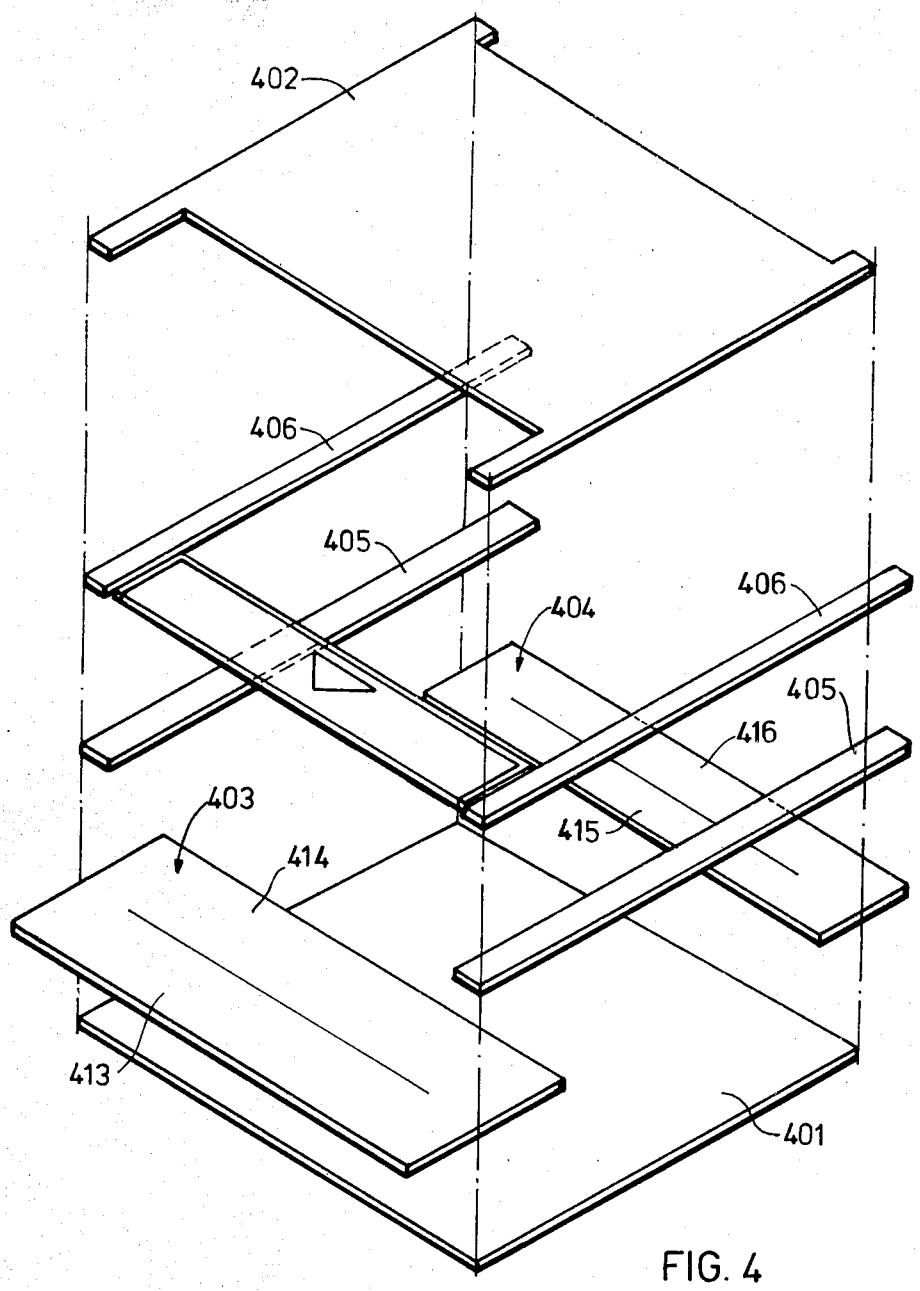
FIG. 4 is an exploded view of an image unit according to the invention with spacer strips and masking strips which both are extended in length on the side of the trap and folded over.

FIG. 4 illustrates another advantageous embodiment of the present invention. In this embodiment, the masking parts 414 and 415 of the masking folding sheets are bonded to the image sheet 401, and the lateral masking strips 405 are then applied. On the side of the trap, these masking strips 405 extend over the rear edge of the image sheet 401 by slightly less than the width of the folding part 416. The cover sheet 402 has the same form as in the embodiments previously described but the lateral spacer strips 406 initially extend over the rear edge of the film unit in the same way as the masking strips 405. When the part 416 is folded over, the overhanging parts of the masking and spacer strips are also folded over and permanently bonded to the cover sheet 402.

The folded-over parts of the masking and spacer strips produce lateral thickenings in the region of the trap, which lift the pressure rollers of the camera and so contribute to the formation of a trap cavity.

Figure 5:
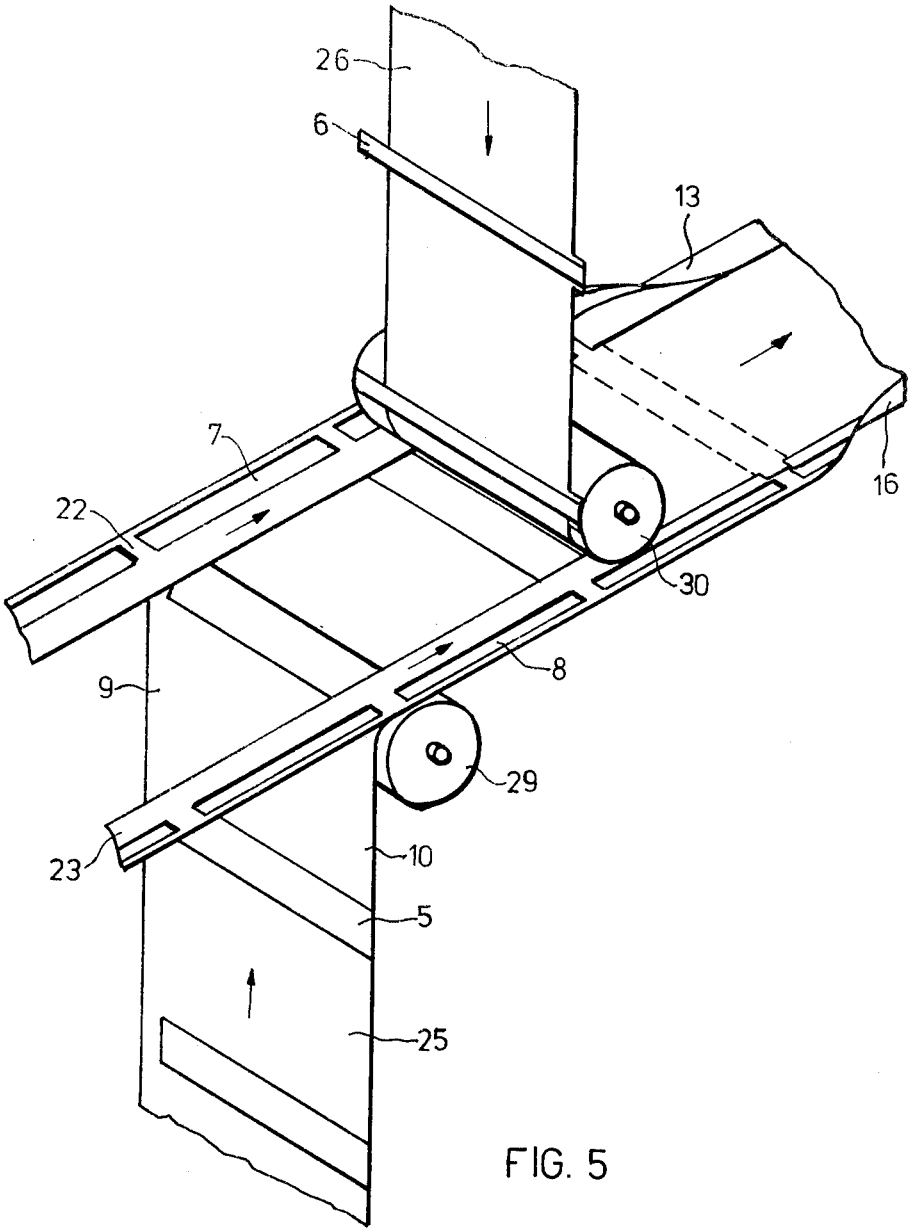
FIG. 5 is a perspective view of the manufacturing process.

FIG. 5 illustrates by way of example a possible manufacturing process. In the process of manufacturing, preferably materials for the individual parts of the film unit as far as possible are used in form of strips. The process advantageously begins with the application of the container 7 for developer paste and of the trap inserts 8 to the parallel strips 22 and 23 of the masking folding sheets 3 and 4 arranged on the side of the container and the side of the trap. The lateral masking strips 5 are applied in double width to the strip 25 of image sheets 1 at intervals of a film unit. The strips 22 and 23 forming the masking folding sheets 3 and 4 and the strip 25 which forms the image sheets 2 are carried in correct registration above one another and bonded together. The strip 26 forms the cover sheets 2 which are already fitted with double widths of spacer strips 6 and punched out on both sides to form the narrow marginal portions 17*a*, 17*b* and 18*a*, 18*b* and to receive the shortened middle portions 19 and 20. The folding parts 13 and 16 of the masking folding sheets 3 and 4 are then folded over and joined to the cover sheet 2 of the strip 26. As a final operation, the finished combination is separated into individual film units by cutting it transversely along the middle of the spacer strips 6 and lateral masking strips 5 (not shown).

We claim:

1. Photographic film unit having an integral structure, consisting of an image sheet and a cover sheet which are substantially in registration, a container for photographic developer material being situated at the front end of the film unit and a trap for receiving excess developer material at the rear end, and the image sheet and cover sheet being joined together through a mask situated between them which forms a boundary to the image area and by separate lateral spacer strips, characterized in that the mask is in the form of a multi-part mask combination composed of a masking folding sheet associated with the container for photographic developer material and another associated with the trap and a separate lateral masking strip for each side, and the folding parts of the two masking folding sheets are folded back parallel to the corresponding outer edges of the film unit within the contour of the film unit and placed on the cover sheet and permanently fixed to it.

2. Photographic film unit according to claim 1, characterised in that the masking parts of the masking folding sheets on the side of the container and on the side of the trap are chamfered off on the side facing the image area.

3. Photographic film unit according to claim 1, characterised in that the lateral masking strips have chamfered off portions on the side facing the image area.

4. Photograhic film unit according to claim 1, characterised in that the masking part of the masking folding sheet on the side of the container intersects with and is permanently bonded to the two lateral masking strips.

5. Photographic film unit according to claim 1, characterised in that the masking part of the masking folding sheet on the side of the container has lateral notches.

6. Photographic film unit according to claim 5, characterised in that the lateral notches of the masking part of the masking folding sheet on the side of the container are so wide that the lateral spacer strips fit into them.

7. Photographic film unit according to claim 1, characterised in that the masking part of the masking folding sheet on the side of the trap intersects with and is permanently bonded to the two lateral masking strips.

8. Photographic film unit according to claim 1, characterized in that the lateral masking strip to bound the image area on both sides is made by a thin application of material.

9. Photographic film unit according to claim 8, characterised in that the material on the two sides is applied from the liquid phase.

10. Photographic film unit according to claim 8, characterised in that the material on the two sides consists of transfer material.

11. Photographic film unit according to claim 1, characterised in that the lateral masking strips and the spacer strips intersect the masking part of the masking folding sheet on the side of the trap, initially extend over the rear edge of the image sheet by approximately the width of the folding part of the masking folding sheet on the side of the trap, and are then folded back on the cover sheet together with the folding part to form a thickening of the edge and permanently bonded to said cover sheet.

12. A process for the manufacture of the photographic film unit according to claim 1, characterized in that at the same time the containers for developer material and the trap inserts are applied and fixed to two parallel masking folding sheet strips arranged on the side of the container and on the side of the trap, in each case to the appropriate folding parts; that the lateral masking strips are applied in double width to the image sheet strip at intervals equal to the width of the film units and fixed thereto; that by means of a deflecting body the image sheet strip is brought together with the two masking folding sheet strips in correct registration and bonded together; that the cover sheet strip is punched out on both sides; that the cover sheet strip is equipped with spacer strips in double width; that the punched cover sheet strip with the spacer strips is applied to the combination of strips from above and fixed thereto by another deflecting body; that a folding device folds the folding parts of the two masking folding sheet strips over the cover sheet strip parallel to the corresponding outer edges of the film unit and bonds them to the outside of the cover sheet strip; and that lastly the finished combination of strips is separated into individual film units by a traverse cutting device cutting along the middle of the spacer strips and of the lateral masking strips.

13. Photographic film unit according to claim 1, characterized in that the lateral masking strip for each side is made from a film in a thickness of from 5 to 50 μm.

* * * * *